US009273443B2

(12) United States Patent
Freitag et al.

(10) Patent No.: US 9,273,443 B2
(45) Date of Patent: Mar. 1, 2016

(54) BUILDING WITH REINFORCED GROUND

(75) Inventors: Nicolas Freitag, Orsay (FR); Jean-Claude Morizot, Paris (FR); Gilles Berard, Le Plessis Robinson (FR)

(73) Assignee: TERRE ARMEE INTERNATIONALE, Velizy Villacoublay (FR)

( * ) Notice: Subject to any disclaimer, the term of this patent is extended or adjusted under 35 U.S.C. 154(b) by 197 days.

(21) Appl. No.: 13/637,000

(22) PCT Filed: Mar. 25, 2010

(86) PCT No.: PCT/FR2010/050552

§ 371 (c)(1),
(2), (4) Date: Sep. 24, 2012

(87) PCT Pub. No.: WO2011/117476

PCT Pub. Date: Sep. 29, 2011

(65) Prior Publication Data

US 2013/0008098 A1 Jan. 10, 2013

(51) Int. Cl.

| | |
|---|---|
| ***E02D 5/74*** | (2006.01) |
| ***E04B 1/20*** | (2006.01) |
| ***E04B 1/16*** | (2006.01) |
| ***E02D 29/02*** | (2006.01) |

(52) U.S. Cl.

CPC ..... *E02D 29/0241* (2013.01); *E02D 29/0225* (2013.01); *E02D 29/02* (2013.01); *E02D 29/0233* (2013.01)

(58) Field of Classification Search

CPC ..... E02D 29/0241; E02D 29/0225; E02D 29/0233; E02D 29/02

USPC ..... 52/169.5, 169.11, 169.14, 302.3, 340, 52/341, 337, 333, 326, 319, 388, 608, 52/489.1, 166

See application file for complete search history.

(56) References Cited

U.S. PATENT DOCUMENTS

| | | | | |
|---|---|---|---|---|
| 1,170,419 | A * | 2/1916 | Coon et al. | 52/426 |
| 4,765,115 | A * | 8/1988 | Pollina | 52/712 |
| 4,952,098 | A * | 8/1990 | Grayson et al. | 405/262 |
| 5,207,043 | A * | 5/1993 | McGee et al. | 52/379 |
| 5,259,704 | A * | 11/1993 | Orgorchock | 405/262 |
| 5,490,366 | A * | 2/1996 | Burns et al. | 52/713 |
| 5,671,582 | A * | 9/1997 | Reay | 52/745.05 |
| 6,122,859 | A * | 9/2000 | Lazar | 47/44 |
| 6,371,699 | B1 * | 4/2002 | Weinreb | 405/262 |

(Continued)

FOREIGN PATENT DOCUMENTS

| | | |
|---|---|---|
| FR | 2 913 436 | 9/2008 |
| FR | 2 922 234 | 4/2009 |

(Continued)

*Primary Examiner* — Phi A
*Assistant Examiner* — Omar Hijaz
(74) *Attorney, Agent, or Firm* — Dentons US LLP

(57) ABSTRACT

The invention relates to a building including a facing, a backfill at the back of the facing, synthetic reinforcement strips distributed in the backfill, and a connection system between the reinforcement strips and the backfill. The connection system includes fasteners having the shape of a continuous closed loop, each including two first portions for hooking to the facing and, alternating with the first portions along the closed loop shape, two second portions extending towards the back of the facing where they are folded back to form two loops inside of which at least one reinforcement strip extends.

13 Claims, 6 Drawing Sheets

(56) References Cited

U.S. PATENT DOCUMENTS

| | | | | |
|---|---|---|---|---|
| 6,939,087 | B2 * | 9/2005 | Ruel | 405/286 |
| 7,017,318 | B1 * | 3/2006 | Hohmann et al. | 52/562 |
| 7,125,202 | B2 * | 10/2006 | Morizot et al. | 405/262 |
| 7,722,296 | B1 * | 5/2010 | Taylor | 405/262 |
| 7,857,540 | B2 * | 12/2010 | Ruel et al. | 403/208 |
| 8,079,782 | B1 * | 12/2011 | Hilfiker et al. | 405/262 |
| 8,516,768 | B2 * | 8/2013 | Johnson, III | 52/713 |
| 8,689,534 | B1 * | 4/2014 | Chou | 59/78 |
| 2001/0014255 | A1 * | 8/2001 | Orsat | 405/15 |
| 2003/0223825 | A1 * | 12/2003 | Timmons et al. | 405/285 |
| 2005/0265791 | A1 * | 12/2005 | Clack | 405/284 |
| 2006/0171783 | A1 * | 8/2006 | Freitag et al. | 405/262 |
| 2006/0236617 | A1 | 10/2006 | Chen | |
| 2006/0239783 | A1 * | 10/2006 | Kallen | 405/284 |
| 2010/0310322 | A1 * | 12/2010 | Taylor | 405/259.1 |
| 2011/0103897 | A1 * | 5/2011 | Ruel | 405/262 |
| 2011/0146195 | A1 * | 6/2011 | Hohmann, Jr. | 52/713 |
| 2013/0136544 | A1 * | 5/2013 | McKittrick | 405/262 |

FOREIGN PATENT DOCUMENTS

| | | |
|---|---|---|
| WO | WO 2007/102070 | 9/2007 |
| WO | WO 2010/063939 | 6/2010 |

* cited by examiner

BUILDING WITH REINFORCED GROUND

The present invention relates to techniques for building reinforced earth structures.

Such structures conventionally comprise a facing, backfill filling a rear side of the facing, reinforcement components distributed in the backfill to stabilise it mechanically, and a connection system between the reinforcement components and the backfill.

The invention addresses reinforcement components in the form of flexible synthetic strips. This type of reinforcement is commonly used due to its mechanical performance and good corrosion resistance.

There are different types of facing, each with its preferred field of application. There are in particular concrete facings, precast or cast in situ, and facing made up of metal mesh.

For concrete facing, the connection between the reinforcement strips and the concrete is traditionally a source of difficulties. As far as possible, intermediate connecting parts working in bending or shear should be eliminated. One possibility is to provide a passage in the concrete facing element that the reinforcement strip will follow once installed and that can be used to anchor the strip to the facing. A solution of this type is described in WO 2007/102070. However, this type of solution constrains the direction of the reinforcement strips immediately behind the facing, which can cause installation problems in certain configurations of the retaining structure.

There is therefore a need for a connection method that retains good mechanical properties while offering good flexibility with regard to the possible configurations of the reinforcement strips.

Mesh type facing is rarely used in conjunction with backfill reinforcement components in the form of flexible synthetic strips. One reason for this could be that when the strips are attached to the mesh, they are directly visible on the front face of the structure, which exposes them to accidental or intentional damage. Furthermore, mesh type facing is often used in conjunction with stony backfill, which is not a favourable environment for the use of a reinforcement based on flexible strips. There is also a need to overcome these limitations.

A building structure is proposed, comprising facing, backfill on a rear side of the facing, synthetic reinforcement strips distributed in the backfill and a connection system between the reinforcement strips and the backfill. The connection system includes fasteners having the shape of a continuous closed loop, each including two first portions for hooking to the facing and, alternating with the first portions along the closed loop shape, two second portions extending towards the back of the facing where they are folded back to form two loops inside of which at least one reinforcement strip passes.

The use of fasteners having the shape of a continuous closed loop makes it possible to connect the strips firmly to the facing, avoiding the use of intermediate parts subject to shear stresses. The continuous nature of the closed loop limits the risk of losing the connection by deformation of the fasteners due to the significant tensile stresses that they can undergo from the reinforcement strips due to the load formed by the backfill. The topology of the fastener means that it can be installed in a variety of configurations.

A guide device can be arranged between the two loops formed by the second portions of a fastener on the one hand and the reinforcement strip passing inside these two loops on the other hand, so that the device works in compression in response to tension exerted by the reinforcement strip.

In one embodiment of the structure, the fastener is metallic and substantially rigid. This type of embodiment is particularly appropriate when the facing is in the form of mesh, in which case the first portions of a fastener are placed around at least one bar of the mesh.

If the facing comprises several mesh elements, it may be possible to use a fastener to contribute to assembling such elements, by placing its first portions around at least two bars of two adjacent mesh elements respectively.

In particular, the backfill in a retaining structure sometimes comprises two layers, one adjacent to the mesh facing, made up of coarse-grained material, such as stones, and the other located further back and made from a finer material such as earth or sand. In this case, the rigid fastener makes it possible to distance the cusp points of the synthetic reinforcement strips from the facing by extending them mainly in the layer of finer material, while the rigid fasteners extend in the layer of coarser material to connect the reinforcement strips.

In another embodiment of the structure, the fastener is a flexible belt based on fibres wound into a closed loop. In this case, the guide device, if one is provided between the two loops formed by the second portions of a fastener and the reinforcement strip passing inside these two loops, can comprise a first curved surface to receive the reinforcement strip and a second curved surface to receive the two loops of the second portions of the flexible belt, the first and second surfaces having their respective curvatures in two perpendicular planes. Spacers can be provided to separate the second portions of the flexible belt received on the second curved surface of the guide device to ensure better transmission of the stresses at the connection.

The fastener in the form of a flexible belt is particularly appropriate when the facing is made from a moulded material incorporating, in at least one anchor zone, a passage with a flattened cross-section formed between two emergence points located on a rear side of the facing adjacent to the backfill. The first portions of the flexible belt are then placed inside the passage formed in the anchor zone of the facing. The flexibility of the belt makes it possible to orient the reinforcement strips in the backfill without being excessively constrained by the directions imposed by the passage at its emergence points in the facing. In a particular embodiment, the passage comprises two portions adjacent to the two emergence points, each one arranged to orient an elongated element engaged in said passage parallel to an emergence plane substantially perpendicular to the rear face of the facing, two curved portions extending the two portions adjacent to the emergence points respectively and arranged to deviate the element from the emergence plane, and a connection portion linking the two curved portions to each other and having at least one loop located outside the emergence plane.

According to another aspect, a construction method is proposed for a reinforced earth structure, comprising: (i) erecting a facing on a front side of the structure; (ii) installing on the facing fasteners having the shape of a continuous closed loop, each having two first portions for hooking to the facing and, alternating with the first portions along the closed loop shape, two second portions extending towards the back of the facing where they are folded back to form two loops; (iii) connecting synthetic reinforcement strips to the facing, by passing at least one reinforcement strip inside the two loops that form the second portions of a fastener; and (iv) backfilling a rear side of the facing in which the reinforcement strips connected to the facing by means of the fasteners extend.

When the facing is in the form of mesh, the fasteners can be substantially rigid and arranged by passing the first portions thereof around at least one bar of the mesh.

When the facing is made from a moulded material incorporating, in at least one anchor zone, a passage with a flattened cross-section formed between two emergence points located on a rear side of the facing, the fastener can be a flexible belt based on fibres wound into a closed loop. In this case, the connection of the synthetic reinforcement strips to the facing can comprise stages consisting of folding the flexible belt on itself and engaging one end of the folded belt in said passage at one of the emergence points, threading the folded belt into the passage until it comes out of the other emergence point of the passage, making the lengths of belt protruding from the two emergence points even, leaving the two said first portions in the passage, joining the two ends of the belt opposite the facing to form the loops of said second portions, and passing at least one reinforcement strip inside the two loops.

Further features and advantages of the present invention will become apparent from the following description of a non-limitative embodiment, with reference to the attached drawings, in which.

Figure 1:
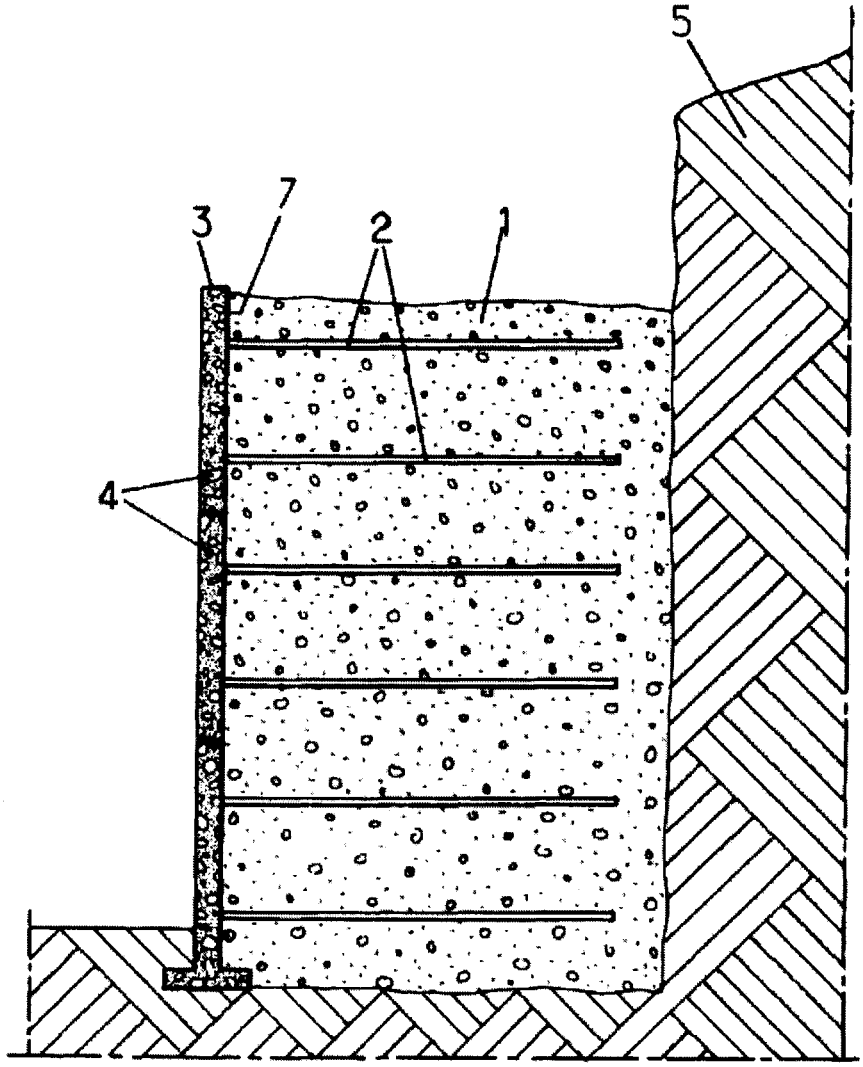
FIG. 1 is a diagrammatic cross-sectional view of a reinforced earth retaining structure.

FIG. 1 shows the application of the invention to the construction of a reinforced earth retaining wall. Compacted backfill 1, in which reinforcements 2 are distributed, is delimited on the front side of the structure by a facing 3 that, in the example shown in FIG. 1, is formed by juxtaposing panel-shaped prefabricated elements 4, and on the rear side by the ground 5 against which the retaining wall is erected.

The reinforcements 2 consist of synthetic reinforcements in the form of flexible strips extending in planes horizontal to the rear of the facing 3. These can in particular be reinforcement strips based on polyester fibres with polyethylene sleeves.

The reinforcement strips 2 are fastened to the prefabricated elements 4 assembled to form the facing 3. These elements 4 are made from reinforced concrete, for example. In the example shown, they are in the form of panels. They could also take other forms, particularly blocks. When the concrete in such an element 4 is poured, a passage is created along a predefined path for a reinforcement strip in order to produce the anchorage between the strip and the element. Once it has been installed along this path, each strip has two sections that protrude from the element so that they can be installed in the backfilled block.

To build the structure, the following steps can be carried out:

a) position some of the facing elements 4 so that backfill material can then be placed over a certain height. In a known manner, the assembly and positioning of the facing elements can be facilitated by assembly components placed between them. The positions provided on the facing elements 4 for the strips 2 are selected so that some of them are placed at the same horizontal level during assembly;

b) placing fill material and compacting it progressively until the next level at which the installation of the reinforcement strips 2 is planned;

c) installing one or more reinforcement strips 2 by fastening them to the facing and spreading them on the backfill 1 at this level;

d) placing fill material on top of the reinforcement strips 2 that have just been installed. This fill material is compacted as it is placed.

e) repeating steps b) to d) if several layers of strips are planned per row of facing elements 4;

e) repeating steps a) to e) until the top level of backfill is reached.

When the fill material is being placed and compacted, the reinforcement strips 2 already installed in the lower levels become taut. This tensioning results from the friction between the strips and the fill material, and strengthens the structure.

Figure 2:
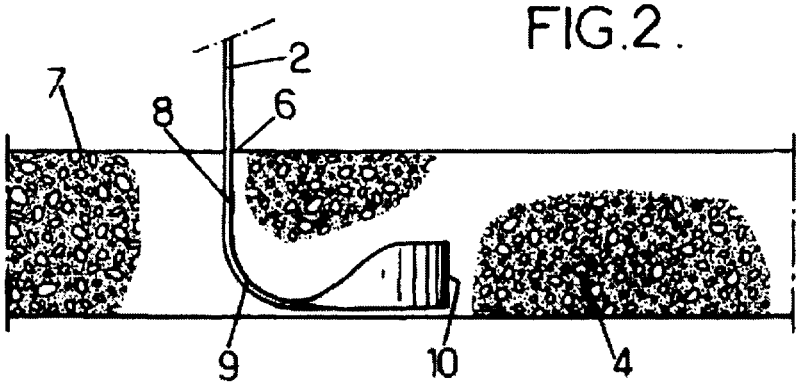
FIGS. 2 and 3 are cross-sectional and perspective diagrams showing the path followed in the facing by a synthetic reinforcement strip in a first embodiment.
Figure 3:
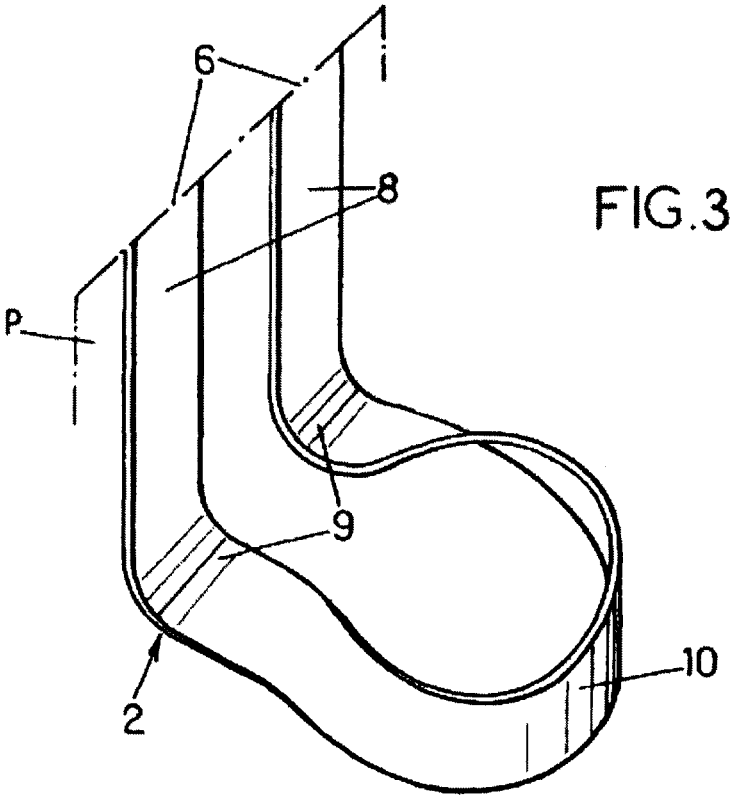

FIGS. 2 and 3 show a possible configuration of the reinforcement strips in concrete facing, as described in WO 2007/102070 A2. At their emergence points 6 from a facing element, the two sections of a strip 2 are parallel to an emergence plane P, without any offset perpendicular to the plane P (as shown in FIGS. 2 and 3) or with such an offset (cf. WO 2010/063939). On assembly of the facing 3, the elements 4 are generally oriented so that this emergence plane is horizontal.

FIG. 2 is a diagrammatic illustration of a facing element that can be used in some embodiments, with the path of a reinforcement strip. As is usual, the element 4 is made from cast concrete. A path is defined inside the element 4, between the two emergence points 6 of the two sections of the strip on the rear face 7 of the element (face adjacent to the backfill). The path corresponding to the element in FIG. 2 is shown by FIG. 3. It has two straight portions 8 extending perpendicular to the rear face 7 of the element from the emergence points 6. In each straight portion 8, the strip stays in its emergence plane P. The straight portions 8 extend over at least half of the thickness of the body of the element 4, measured perpendicular to its rear face 7. This prevents any detrimental stress on the concrete near the rear face 7. Each straight portion 8 of the path of the strip is extended by a respective curved portion 9 where the strip is deviated from the emergence plane P. Beyond this curved portion 9, the strip 2 extends along the front face of the element, a little set back from said front face so that it is not visible on the surface of the structure. The two curved portions 9 are connected to each other by a connecting portion that has a loop 10 located outside the emergence plane P.

Figure 4:
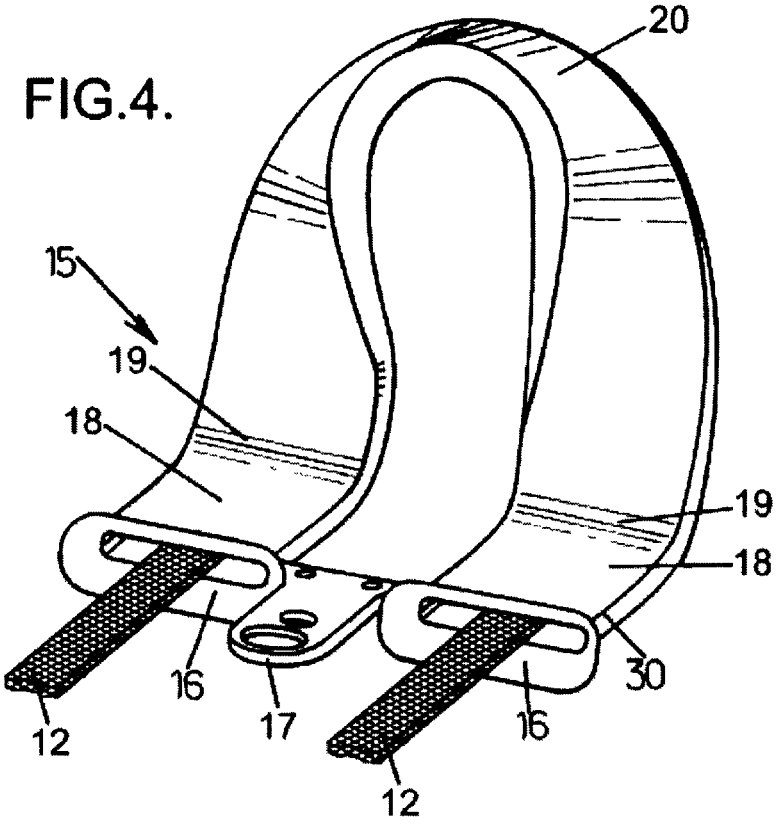
FIG. 4 is a perspective view of a part that can be used to define the path of a reinforcement strip inside a facing element in the first embodiment.

In practice, the concrete of the element 4 is not poured with the synthetic strip installed directly in the mould. Rather, a guide part 15 such as the one shown in FIG. 4 is arranged in the mould.

This part 15 comprises a sheath made from rigid plastic, the inner cross-section of which is flattened to form the passage that will receive the reinforcement strip 2. The sheath is shaped along the predefined path that the strip 2 must follow in the thickness of the concrete element. It thus comprises portions 18, 19, 20 that define the straight portions 8, the curved portions 9 and the connecting portion 10 described with reference to FIGS. 2 and 3. The ends 16 of the sheath are flared in order to facilitate the insertion of the strip 2. Between these two ends 16, the part 15 has a lug 17 that protrudes relative to the concrete to stiffen the sheath and ensure that it stays in position when the concrete of the element is poured. A pulling component such as a cable, a cord or a strap 12 can be placed inside the sheath in order to subsequently install the reinforcement strip.

Although the flared ends 16 of the sheath permit a certain deviation of the strips 2 at the rear of the facing 4, these deviations are limited, particularly parallel to the emergence plane P of the strips outside the concrete. To overcome this limitation, a fastener in the form of a flexible belt such as the one shown in FIG. 5 can be used.

This fastener in the form of a flexible belt 30 is based on fibres wound into a closed loop, for example polyester fibres of the same type as those used in the reinforcement strips 2. A sleeve, for example made from canvas, can be placed around the braid formed by the wound fibres.

Figure 5:
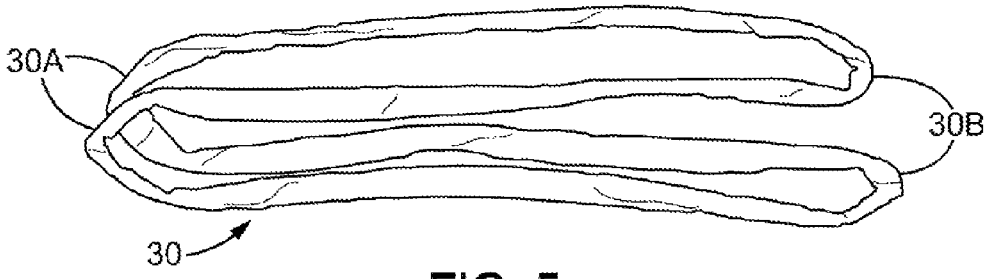
FIG. 5 is a view of a fastener that can be used to connect a reinforcement strip to the facing in the first embodiment.

The drawing in FIG. 5 gives a suggestion of the configuration of the fastener 30 in the form of a flexible belt once it is installed in the structure: two portions 30A are curved and will form two loops engaged together along the path defined by the sheath 15 in the facing element, while two other portions 30B, which alternate with the portions 30A along the closed loop shape of the fastener 30, will be used for the connection of a reinforcement strip 2.

Figure 6:
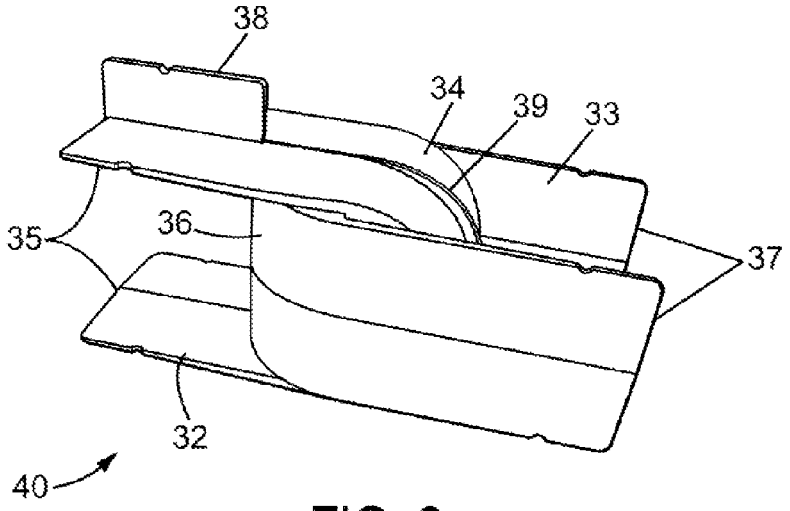
FIG. 6 is a perspective view of a guide device that can be used between the fastener and the reinforcement strip in the first embodiment.

This connection between the fastener 30 and the reinforcement strip 2 is preferably made by means of a guide device 40, an embodiment of which is shown in FIG. 6. In this example, the guide device comprises two guides 32, 33 interleaved with each other. The first guide 32 is intended to receive the looped portions 30B of the fastener 30, while the second guide is intended to receive the reinforcement strip 2 to make it turn back inside the backfill 1. The guide 32 has a curved surface 34 used to deviate and guide the looped portions 30B, extended by two substantially parallel wings 35. Similarly, the second guide 33 has a curved surface 36 to deviate and guide the reinforcement strip 2, extended by two wings 37.

The wings 35 of the first guide 32 have spacers in the form of ribs 38 that are used to separate the guided portions 30B of the flexible belt received on the curved surface 34. A spacer rib 39 can also be provided on the curved surface 34 itself.

Once the assembly is complete, the portions 30B of the belt 30 follow the guide 32 along the wings 35 and fold around the curved surface 34. They are kept separate from each other by the spacers 38, 39 to prevent the two sections of fibre braid forming it from overlapping. The reinforcement strip 2 bypasses the guide 33, following the wings 37 and the curved surface 36.

The surfaces 34, 36 have their respective curvatures in two perpendicular planes. They will be positioned so that the plane in which the first guide 32 has its curvature is substantially horizontal, which makes it possible to position the reinforcement strips 2 horizontally in the backfill. Between the two curved surfaces 34, 36, the guide device works in compression, which is a preferred mode of stress. Between these two surfaces 34, 36, the two guides 32, 33 can rest against each other by means of a flat surface. As a variant, the guide device 40 can be formed as a single piece with the same shape as the shape formed by joining the two guides 32, 33 described above.

Figure 7:
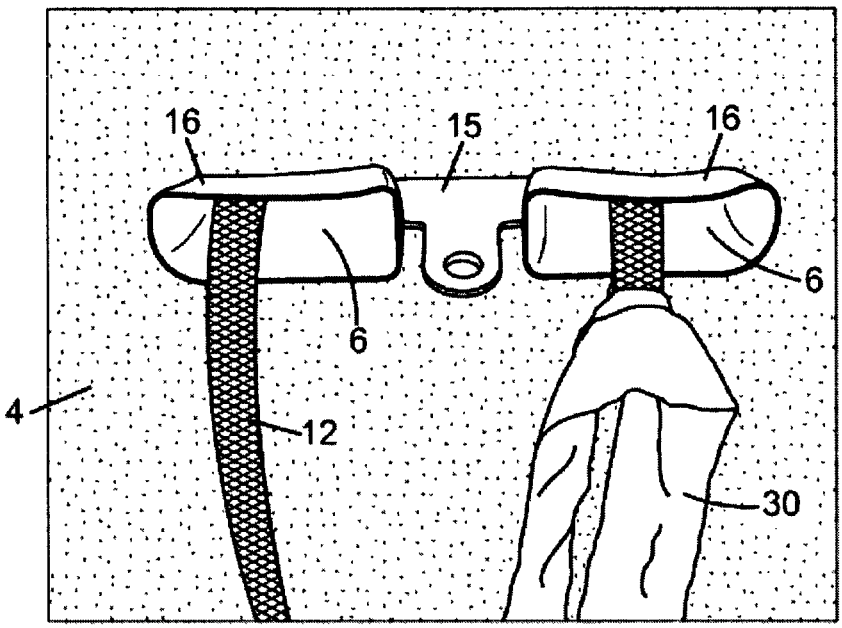
FIGS. 7 to 9 are diagrams showing the stages of installing a reinforcement strip in the first embodiment.
Figure 8:
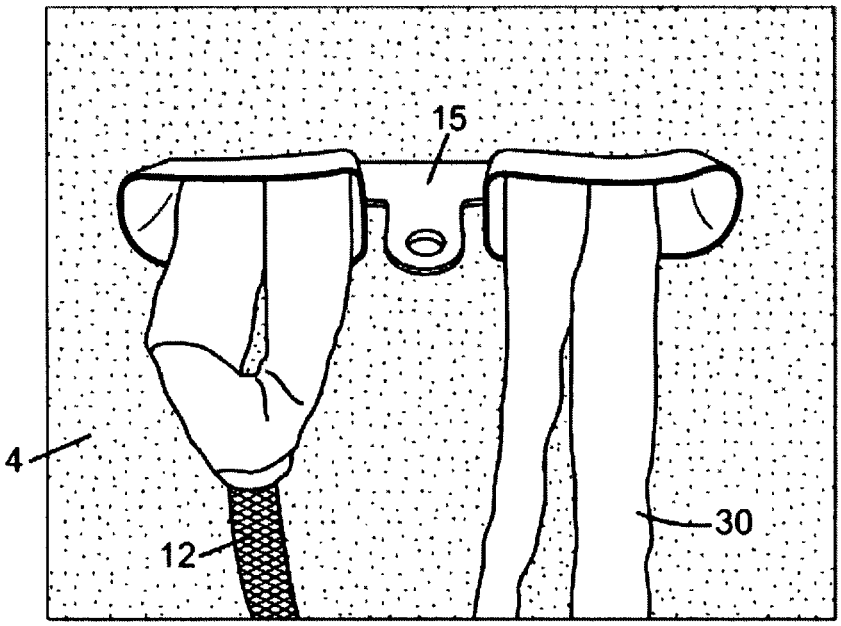
Figure 9:
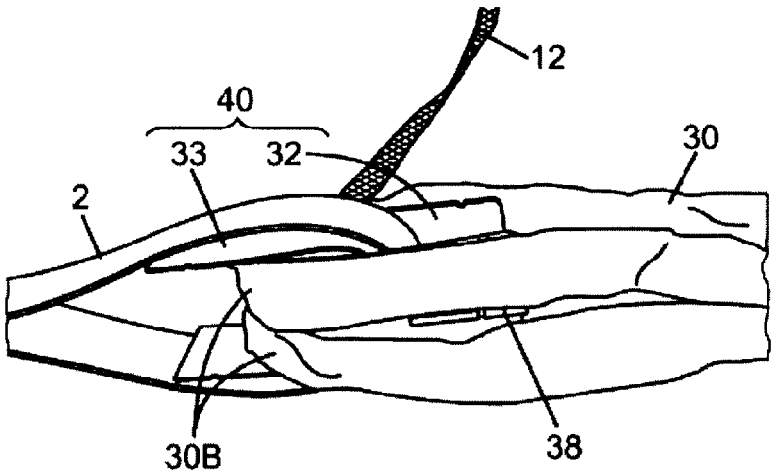

FIGS. 7 to 9 show the assembly of the connection system comprising a flexible belt 30 as described with reference to FIG. 5 and a guide device 40 as described with reference to FIG. 6.

FIG. 7 shows a cast concrete facing element 4 in which a part 15 of the type shown in FIG. 4 has been incorporated. The flexible fastener 30 is attached to the strap 12 prepositioned in the sheath, near one of the flared ends 16 of the sheath located at one of the emergence points 6 of the flattened cross-section passage formed in the concrete by the part 15. At the other end 16, the strap 12 is pulled, which engages the flexible fastener 30 folded on itself in the passage, and it is pulled along the passage until it comes out of the element 4 as shown in FIG. 8. The strap 12 and/or the fastener 30 are then pulled again to even up the double lengths of belt protruding from the facing element 4. At this stage, the two portions 30A of the fastener 30 in the form of a flexible belt have been positioned in the passage formed by the sheath in the part 15, and the guide device 40 can be positioned on the two portions 30B of the fastener 30 furthest from the facing, as shown in FIG. 9.

For such positioning, the device 40 is placed in the two loops formed by the portions 30B of the belt, applied against the curved surface of the guide 32. These two loops are made parallel and separated from each other in the guide device 40 by the spacers 38. The reinforcement strip 2 is then passed inside the two loops 30B, running it along the curved surface of the other guide 33. The strap 12 can optionally be used to hold the strip 2 in place by knotting the strap around the device 40. The strip 2 can then be tensioned. The designer of the structure can orient the strip as he wishes in a horizontal plane due to the flexibility of the fastener 30.

Figure 10:
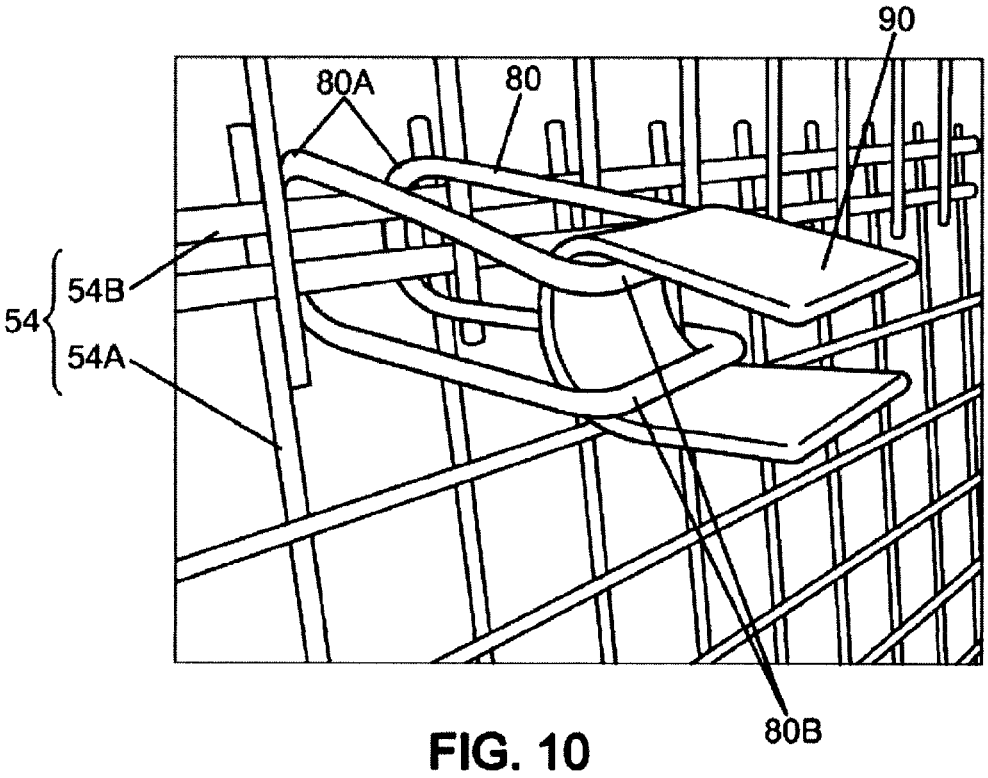
FIG. 10 is a perspective view of a facing, a fastener and a reinforcement strip in a second embodiment.

Another embodiment of the reinforced earth structure is shown in FIG. 10. In this case, the facing is produced using metal mesh 54 and the fastener 80 in the shape of a continuous closed loop is rigid.

The rigid fastener 80 can be produced by shaping one or more metal rods and welding the ends to each other to ensure continuity of the closed loop shape.

The shaping of the fastener gives it two curved portions 80A intended to be hooked behind one or more metal bars of the mesh 54 and, alternating with the portions 80A along the shape of the closed loop, two other curved portions 80B, for the connection of a reinforcement strip.

This connection uses a guide device that, in the example, comprises a single guide 90 in the form of a plate bent so that it has an inner face resting against the curved portions 80B of the fastener and a curved outer face to receive a reinforcement strip 2. The plate forming the guide 90 works in compression when the connected reinforcement strips tighten behind the facing.

The rigid fastener 80 is robust and very easy to install on the mesh-type facing 54. It can optionally contribute to the assembly of adjacent mesh panels 54A, 54B, as shown in FIG. 10, by being placed around several bars of the panels 54A, 54B respectively.

A strip-facing connection system of the type shown in FIG. 10 is well-suited to backfill placed in several layers, including a first layer placed on the ground 5 against which the structure is being built and a second layer of relatively coarse material, such as stones for example, placed on the front face of the structure for aesthetic purposes. The first layer, in which the strips 2 extend, is made from a finer material than the second layer to avoid damaging the synthetic strips.

The fastener 80 makes it possible to prevent the reinforcement strips 2 from being visible on the front face of the structure. In addition, offsetting the strips 2 to the rear improves the fire resistance of the structure as they are less quickly exposed to a temperature increase in front of the facing.

It will be understood that the invention is not limited to the particular embodiments described above, and a number of variants can be designed without departing from the scope defined by the appended claims.

The invention claimed is:

1. A building structure comprising:

a facing;

a backfill on a rear side of the facing;

synthetic reinforcement strips distributed in the backfill;

a connection system connecting the reinforcement strips and the facing, wherein the connection system includes one or more fasteners each having the shape of a continuous closed loop, each fastener having:

two first portions for hooking to the facing; and two second portions alternating with the first portions along the closed loop shape, resulting in the succession, along a path of the closed loop path of one of the two first portions, one of the two second portions, the other one of the two first portions, and the other one of the two second portions, the two second portions extending towards the back of the facing where said second portions are folded back to form two loops inside of which passes at least one reinforcement strip among said reinforcement strips, and at least one guide device arranged outside the facing and interposed between the two loops formed by the second portions of each fastener and the reinforcement strip passing inside the two loops and extending around the guide device, such that the guide device is compressed in response to a tension exerted by the reinforcement strip.

2. The building structure of claim 1, wherein the fastener is substantially rigid.

3. The building structure of claim 2, wherein the facing is in the form of mesh, the first portions of each fastener being placed around at least one bar of the mesh.

4. The building structure of claim 3, wherein the facing comprises several mesh elements, the two first portions of each fastener being placed around at least two bars of two adjacent mesh elements respectively.

5. The building structure of claim 2, wherein the backfill comprises:

a first layer in which the reinforcement strips extend; and a second layer located between the first layer and the facing, in which at least some of the fasteners extend, the second layer of backfill being made from a material that is less fine than the first layer.

6. The building structure of claim 1, wherein the fastener is a flexible belt based on fibres wound into a closed loop.

7. The building structure of claim 6, further comprising:

at least one guide device placed between the two loops formed by the second portions of one fastener and the reinforcement strip passing inside the two loops, wherein the guide device comprises a first curved surface to receive a U-turn of the reinforcement strip and a second curved surface to receive the two loops of the second portions of the flexible belt, the first and second surfaces having respectively first and second curvatures in two perpendicular planes.

8. The building structure of claim 7, wherein the guide device comprises spacers to separate the second portions of the flexible belt received on the second curved surface of the guide device.

9. The building structure of claim 6, wherein the facing is made from a moulded material incorporating, in at least one anchor zone, a passage with a flattened cross-section formed between two emergence points located on a rear face of the facing adjacent to the backfill, and wherein the first portions of the flexible belt are placed inside said passage.

10. The building structure of claim 9, wherein said passage comprises:

a. two portions adjacent to the two emergence points, each of the two portions arranged to orient an elongated element engaged in said passage parallel to an emergence plane substantially perpendicular to the rear face, b. two curved portions extending the two portions adjacent to the emergence points respectively and the two curved portions being arranged to deviate the elongated element from the emergence plane, and c. a connection portion linking the two curved portions to one another and having at least one loop located outside the emergence plane.

11. A construction method for a reinforced earth structure, comprising:

erecting a facing on a front side of the structure;

installing on the facing fasteners having the shape of a continuous closed loop, each fastener including two first portions for hooking to the facing and, two second portions alternating with the first portions along the closed loop shape, resulting in the succession, along the closed loop shape of one of the two first portions, one of the two second portions, the other one of the two first portions and the other one of the two second portions, the two second portions extending towards the back of the facing where said second portions are folded back to form two loops;

connecting synthetic reinforcement strips to the facing by passing at least one reinforcement strip inside the two loops formed by the second portions of each fastener;

backfilling a rear side of the facing where the reinforcement strips extend, connected to the facing using the fasteners, wherein at least one guide device is arranged outside the facing and is interposed between the two loops formed by the second portions of each fastener and the reinforcement strip passing inside said two loops and extending around the guide device, such that the guide device is compressed in response to a tension exerted by the reinforcement strip.

12. The construction method according to claim 11, wherein the facing is in the form of a mesh, and wherein the fasteners are substantially rigid and arranged by passing the first portions thereof around at least one bar of the mesh.

13. The construction method according to claim 11, wherein the facing is made from a moulded material incorporating, in at least one anchor zone, a passage with a flattened cross-section formed between two emergence points located on a rear face of the facing, wherein the fastener is a flexible belt based on fibres wound into a closed loop, wherein connecting the synthetic reinforcement strips to the facing comprises:

folding the flexible belt on itself and engaging one end of the folded belt into said passage at one of the emergence points;

threading the folded belt into said passage until it comes out at the other emergence point of the passage;

making the lengths of belt protruding from the two emergence points even, leaving said first portions in the passage;

joining the two ends of the belt opposite the facing to form said loops of the second portions; and passing at least one reinforcement strip inside the two loops.

* * * * *